US007435463B2

(12) United States Patent
Yamano et al.

(10) Patent No.: US 7,435,463 B2
(45) Date of Patent: Oct. 14, 2008

(54) TRANSFER MEDIUM FOR TRANSFERRING PROTECTIVE LAYER

(75) Inventors: Tadamichi Yamano, Osaka (JP); Jun Sogabe, Osaka (JP)

(73) Assignee: Fujicopian Co., Ltd., Osaka-shi (JP)

( * ) Notice: Subject to any disclaimer, the term of this patent is extended or adjusted under 35 U.S.C. 154(b) by 392 days.

(21) Appl. No.: 11/192,022

(22) Filed: Jul. 29, 2005

(65) Prior Publication Data

US 2007/0026203 A1 Feb. 1, 2007

(51) Int. Cl.
*B41M 5/42* (2006.01)

(52) U.S. Cl. ..... 428/32.51; 428/32.69; 428/32.72

(58) Field of Classification Search ..... None
See application file for complete search history.

(56) References Cited

U.S. PATENT DOCUMENTS 7,008,692 B2 * 3/2006 Usuki et al. ..... 428/331

FOREIGN PATENT DOCUMENTS

| | | |
|---|---|---|
| JP | A 5-57235 | 1/1980 |
| JP | A 5-330259 | 12/1993 |
| JP | 2001-162932 | 6/2001 |

* cited by examiner

*Primary Examiner*—Bruce H Hess
(74) *Attorney, Agent, or Firm*—Antonelli, Terry, Stout & Kraus, LLP.

(57) ABSTRACT

A transfer medium for transferring a protective layer is provided which comprises at least one protective layer provided on a support, the protective layer comprising as a main component by weight an acryl-silica hybrid resin curable by irradiation with an ionizing radiation.

4 Claims, 1 Drawing Sheet

TRANSFER MEDIUM FOR TRANSFERRING PROTECTIVE LAYER

BACKGROUND OF THE INVENTION

The present invention relates to a transfer medium for transferring a protective layer. More particularly, the invention relates to a transfer medium for transferring a protective layer by a thermal transfer method to impart excellent durability to plastics articles in the form of sheet or molded article, images formed on various receptors, etc.

Heretofore, gradation images such as color pictures or monotone images such as letters and symbols have been formed by an electrophotographic method, an ink jet printing method, a thermal transfer method or the like. The thus formed images are frequently required to have scratch resistance or solvent resistance depending upon the type of their uses. There is a method for imparting durability to an image wherein the image is formed on a receptor and a protective layer is formed on the image by solid-printing using a thermal transfer medium (this process is hereinafter referred to as "overprinting"). According to this method, the image can be protected in an easy manner at low cost.

In the overprinting method, the durability of the image can be improved by curing the protective layer. Generally the curing of the protective layer is conducted by using heat or ionizing radiation (see patent reference 1). In the case of curing with heat, the protective layer is previously cured in a state wherein it is present in a thermal transfer medium because the heat curing usually needs a long period time and the heat curing of the protective layer after being transferred results in degradation in easiness of the system. Further the heat curing after the transfer sometimes causes heat deformation of image bearing articles.

In the case of curing using ionizing radiation, the protective layer may be cured before or after the transfer from the viewpoint of easiness of the system. However, when the protective layer is previously cured in a state wherein it is present in the thermal transfer medium to improve the durability as described above, the heat-meltability of the protective layer is markedly degraded resulting in poor selective transferability of the protective layer. The term "selective transferability", as used herein, refers to the property that only a heated portion of a layer is transferred but unheated portions in the periphery of the heated portion are not transferred. As a result, in the transfer of the protective layer at the edge portion of character, there sometimes occurs a phenomenon that a heated portion of the protective layer is transferred together with an unheated portion adjacent to the heated portion (this phenomenon is referred to as "planar peeling"). In this case, it is necessary to make the protective layer thinner to obtain a satisfactory selective transferability and the thickness of the protective layer is limited to a relatively smaller one, resulting in failure to achieve high level durability.

In the case of curing the protective layer by irradiation with an ionizing radiation after the transfer, there are no such problems as mentioned above but there is another problem as follows: Generally ionizing radiation-curable resins have tackiness before curing. A transfer medium wherein a layer of such an ionizing radiation-curable resin is formed on a support cannot be wound into a roll like ink ribbons. It is necessary to apply a separator onto the ionizing radiation-curable resin layer in order to wind the transfer medium into a roll (see patent reference 2), resulting in high cost. Further, it is difficult to form an adhesive layer onto the ionizing radiation-curable resin layer due to the tackiness of the ionizing radiation-curable resin layer. Consequently, the conventional protective layer transfer medium can be only used to apply a protective layer onto a receptor to which the ionizing radiation-curable resin layer shows good adhesion and lacks in application flexibility.

Patent reference 1: JP A 5-330259

Patent reference 2: JP A 5-57235

It is an object of the present invention to provide a transfer medium for transferring a protective layer, which protective layer has excellent selective transferability upon thermally transferring it onto an image formed according to a variety of printing methods to protect the image and does not have tackiness before curing.

This and other objects of the present invention will become apparent from the description hereinafter.

SUMMARY OF THE INVENTION

The present invention provides the following transfer media:

(1) A transfer medium for transferring a protective layer, comprising at least one protective layer provided on a support, the protective layer comprising as a main component by weight an acryl-silica hybrid resin curable by irradiation with an ionizing radiation.

(2) The transfer medium of (1) above, wherein the acryl-silica hybrid resin contains 15 to 60% by weight of a silica component and does not show tackiness at ordinary temperature before curing.

(3) The transfer medium of (1) or (2) above, wherein the acryl-silica hybrid resin has a glass transition temperature of not less than 30° C. before curing.

(4) The transfer medium of any one of (1) to (3) above, which further comprises a thermal adhesive layer as an outermost layer.

DETAILED DESCRIPTION

The present invention will be explained in more detail.

Figure 1:
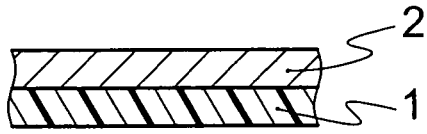
FIG. 1 is a partial cross-sectional view showing an embodiment of the protective layer transfer medium of the present invention.
Figure 2:
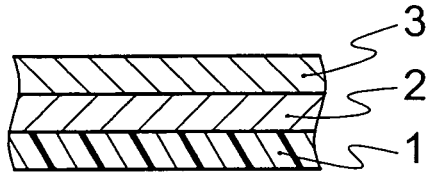
FIG. 2 is a partial cross-sectional view showing another embodiment of the protective layer transfer medium of the present invention.
Figure 3:
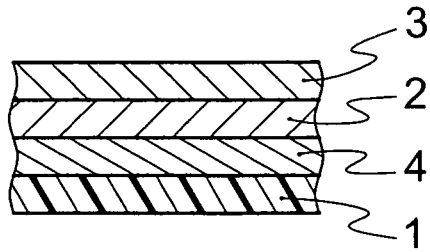
FIG. 3 is a partial cross-sectional view showing a still another embodiment of the protective layer transfer medium of the present invention.
Figure 4:
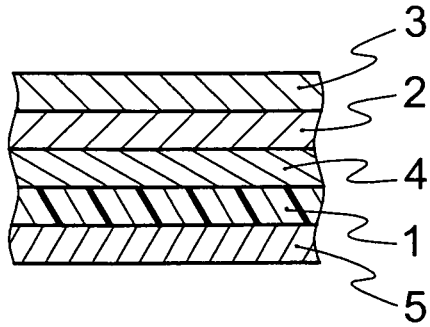
FIG. 4 is a partial cross-sectional view showing a further embodiment of the protective layer transfer medium of the present invention.

The protective layer transfer medium of the present invention will be described with reference to the accompanying drawings. The protective layer transfer medium shown in FIG. 1 has a structure wherein a protective layer 2 is provided on one side of a support 1. The protective layer transfer medium shown in FIG. 2 has a structure wherein a protective layer 2 and a thermal adhesive layer 3 are provided in this order on one side of a support 1. The protective layer transfer medium shown in FIG. 3 has a structure wherein a release layer 4 is provided on one side of a support 1, and a protective layer 2 and a thermal adhesive layer 3 are provided in this order on the release layer 4. The protective layer transfer medium of this embodiment is designed so that the release property of the protective layer is further improved. The protective layer transfer medium shown in FIG. 4 has a structure wherein a heat-resistant lubricating layer is provided on one side of a support 1, a release layer 4 is provided on other side of the support 1, and a protective layer 2 and a thermal adhesive layer 3 are provided in this order on the release layer 4. The protective layer transfer medium of this embodiment is designed so that thermal damage against the support is mitigated.

The layers constituting the protective layer transfer medium of the present invention will be specifically described.

Any supports used in conventional thermal transfer media can be used as they are as the support used in the protective-layer transfer medium of the present invention. Films or sheets which have been subjected to a treatment for improving adhesion against a layer to be provided thereon, and other materials can also be used. Thus, the support used in the protective layer transfer medium of the present invention is not particularly limited.

Typical examples of the support include films of plastics or resins such as polyesters (e.g. polyethylene terephthalate (PET)), polycarbonates, polyamides, polyimides, cellulose acetate, polyvinylidene chloride, polyvinyl chloride, polystyrene, fluororesins, polypropyrene, polyethylene and ionomers; paper sheets such as glassine paper, condenser paper and paraffin paper; and cellophane. Composite films wherein two or more different material films are laminated to each other can also be used. When the protective layer transfer medium of the present invention is used to transfer the protective layer on a shaped plastics article, it is preferable that the protective layer transfer medium of the present invention can be thermally deformed to conform to the profile of the shaped article. In this case, it is preferable to use a support susceptible to a thermal deformation such as easily shapable PET film or acrylic resin film. The thickness of such supports is appropriately varied depending upon the type of the material thereof to provide a suitable strength and heat resistance. Generally, however, the thickness is preferably in the range of 1.0 to 100 μm.

The protective layer transfer medium of the present invention has a protective layer on at least a part of a support. The protective layer comprises at least one layer. The protective layer, when cured by irradiation with an ionizing radiation, possesses satisfactory solvent resistance, water resistance and scratch resistance. In order to achieve such a durability, a protective layer, immediately after the coating thereof during the process of producing the protective layer transfer medium of the present invention, may be irradiated with an ionizing radiation; or a protective layer transfer medium is produced using a transparent support and the thus produced protective layer transfer medium may be irradiated with an ionizing radiation from the transparent support side; and a protective layer transferred on a receptor using the protective layer transfer medium of the present invention may be irradiated with an ionizing radiation. Irradiation with an ionizing radiation any time of the above-mentioned times cures the protective layer to obtain desired durability. However, the irradiation after the transfer is most preferable for the following reason: The curing of the protective layer before the transfer increases the film strength of the protective layer resulting in poor selective transferability at the time of the transfer. Further, since the protective layer becomes hard and brittle, cracks sometimes occur in the protective layer depending upon the transfer conditions and a solvent penetrates through the cracks to an image or the like to be protected. Thus, the curing of the protective layer before the transfer is liable to cause disadvantages. In contrast thereto, the curing of the protective layer after the transfer does not cause the above-mentioned disadvantages. The protective layer has satisfactory selective transferability at the time of the transfer and there occur no cracks in the transferred protective layer resulting in satisfactory solvent resistance.

The protective layer used in the present invention is composed mainly of a resin component and the resin component is required to comprise as a main component by weight an acryl-silica hybrid resin curable by irradiation with an ionizing radiation.

The acryl-silica hybrid resin curable by irradiation with an ionizing radiation refers to a hybrid resin wherein one or more acrylic polymer chains containing at least one (meth)acryloyl group are introduced in particulated silica by chemical bond, preferably covalent bond. When the acryl-silica hybrid resin is irradiated with an ionizing radiation, e.g., ultraviolet ray, the (meth)acryloyl groups cause polymerization reaction to give a cured product wherein silica particles are uniformly dispersed in a crosslinked acrylic resin. The silica particles preferably have an average particle size of not more than 1 μm, especially not more than 0.1 μm. Examples of the ionizing radiation are ultraviolet ray, electron beam, and the like. Usually ultraviolet ray is preferred.

The content of the silica component in the acryl-silica hybrid resin is preferably 15 to 60% by weight, more preferably 20 to 30% by weight. When the content of the silica component is outside the above range, the film strength of the protective layer is low and the function as the protective layer is sometimes degraded.

The acryl-silica hybrid resin preferably does not show tackiness at ordinary temperatures before curing. When a protective layer transfer medium is produced using an acryl-silica hybrid resin having no tackiness and wound into a roll, a disadvantage called "blocking" does not occur. The term "blocking" refers to a phenomenon that when the protective layer transfer medium is wound into a roll, a part of the protective layer is adhered to the opposite side of the support and when the transfer medium is used for transfer, the protective layer in that part is not transferred. Further, there are advantages such as easy design of protective layer transfer medium, including easy lamination when an adhesive layer is provided on the protective layer.

The acryl-silica hybrid resin preferably has a glass transition temperature of not less than 30° C. before curing. An acryl-silica hybrid resin having a glass transition temperature of less than the above range tends to show tackiness at ordinary temperatures.

The acryl-silica hybrid resin preferably has a weight average molecular weight of not less than 10,000, more preferably not less than 20,000. When the molecular weight of the acryl-silica hybrid resin is less than the above range, the hybrid resin tends to show tackiness before curing.

The content of the acryl-silica hybrid resin in the protective layer is preferably not less than 50% by weight, more preferably not less than 80% by weight. When the content of the acryl-silica hybrid resin is less than the above range, a desired durability is prone to not be obtained.

A photoinitiator and/or a sensitizer may be used together with the acryl-silica hybrid resin.

In order to improve the toughness of the protective layer, the protective layer may be further incorporated with (meth) acrylate oligomers or prepolymers each having at least one of acryloyl group and methacryloyl group, such as polyester (meth)acrylate, polyurethane (meth)acrylate, epoxy (meth) acrylate, silicone (meth)acrylate; polyene-thiol resin; monofunctional monomers such as styrene; or polyfunctional monomers such as trimethylolpropane tri(meth)acrylate.

However, since most of these (meth)acrylates are in liquid state before curing or viscous substances, it is necessary to add these (meth)acrylates in such an amount that the protective layer does not assume tackiness.

The protective layer may be further incorporated with one or more thermoplastic resins other than the acryl-silica hybrid resin. Examples of the thermoplastic resins include acrylic resins, vinyl acetate resins, epoxy resins, polyester resins, polycarbonate resins, butyral resins, gelatin, cellulose resins, polyamide resins, vinyl chloride resins, and urethane resins. One or more other additives such as ultraviolet ray absorbents, coloring pigments, white pigments, body pigments, fillers, antistatic agents, antioxidants, fluorescent whitening agents and dyes can be used as required.

The thickness of the protective layer is preferably 0.1 to 10 μm, more preferably 0.5 to 5 μm. When the thickness is less than the above range, the function as the protective layer tends to be insufficient. When the thickness is more than the above range, the cost rises.

In the present invention, it is preferable to provide a thermal adhesive layer on the protective layer to improve adhesion against a receptor. The material for the thermal adhesive layer is preferably selected from substances showing adhesive property upon heating depending upon the type of the material of the receptor. Generally, however, the thermal adhesive layer is preferably made of one or more thermoplastic resins mentioned below. One or more resins having a suitable glass transition temperature are selected from thermoplastic resins showing satisfactory adhesive property upon heating, such as acrylic resins, vinyl acetate resins, epoxy resins, polyester resins, polycarbonate resins, butyral resins, gelatin, cellulose resins, polyamide resins, vinyl chloride resins, and urethane resins.

The thermal adhesive layer can be incorporated with one or more additives such as ultraviolet ray absorbents, coloring pigments, white pigments, body pigments, fillers, antistatic agents, antioxidants, fluorescent whitening agents and dyes, as required.

The thickness of the thermal adhesive layer is preferably 0.1 to 10 μm, more preferably 0.5 to 5 μm. When the thickness is less than the above range, the adhesive strength of the thermal adhesive layer tends to be too low, resulting in poor adhesion of the protective layer against a receptor. When the thickness is more than the above range, the selective transferability at the time of transfer tends to be degraded.

The protective layer transfer medium of the present invention may have a heat-resistant lubricating layer on the rear side of the support, that is, on the opposite side of the support relative to the protective layer in order to prevent the support from adverse influences such as thermal sticking to a thermal head or heat rolls and wrinkling. Conventional resins may be used as the resin used for forming the heat-resistant lubricating layer. Examples of the resins include polyvinyl butyral resin, polyvinyl acetoacetal resin, polyester resins, vinyl chloride-vinyl acetate copolymer, polyether resins, polybutadiene resin, styrene-butadiene copolymer, (meth)acryl polyol, polyurethane (meth)acrylate, polyester (meth)acrylate, polyether (meth)acrylate, epoxy (meth)acrylate, prepolymers of urethane compounds or epoxy compounds, nitrocellulose resin, cellulose acetate propionate resin, cellulose acetate butyrate resin, cellulose acetate hydrogen phthalate resin, cellulose acetate resin, aromatic polyamide resins, polyimide resins, polycarbonate resins, chlorinated polyolefin resins.

In order to improve the heat resistance or film strength of the heat-resistant lubricating layer, or the adhesion strength of the lubricating layer against the support, a cured reaction product of a thermoplastic resin having reactive groups and a polyisocyanate, or a reaction product of the thermoplastic resin having reactive groups and a monomer or oligomer having unsaturated bond can be used. The method for curing such reaction products is not particularly limited, including heating and irradiation with an ionizing radiation.

Generally a lubricating agent is incorporated into the layer composed of the above-mentioned resin or applied onto the layer. Examples of the lubricating agents include phosphoric esters, silicone oils, graphite powder, silicone graft polymers, fluorine-containing graft polymer, silicone polymers such as acryl silicone graft polymer, acryl siloxane and aryl siloxane.

One or more of the above-mentioned resins, one or more lubricating agents and optionally, one or more fillers are dissolved or dispersed into a suitable solvent to give a coating composition for forming a heat-resistant lubricating layer. The coating composition is applied onto the rear side of the support and dried to give a heat-resistant lubricating layer. The coating can be conducted by a conventional method such as a bar coating method, a gravure coating method, screen coating method, or a reverse coating method using a gravure plate. The coating amount of the heat-resistant lubricating layer is preferably 0.1 to 2.0 g/m$^2$ on a solid basis.

In the case that the protective layer is hard to exfoliate from the support, a release layer may be provided between the support and the protective layer. The release layer can be formed by preparing a coating liquid containing at least one selected from waxes, silicone waxes, silicone resins, fluorine-containing resins, acrylic resins, polyvinyl alcohol resins, cellulose derivative resins, urethane resins, vinyl acetate resins, acrylic vinyl ether resins, maleic anhydride resins, and copolymers of two or more foregoing resins, and the like, applying the coating liquid by a conventional method such as a gravure coating method or a gravure reverse coating method, followed by drying.

The release layer can be appropriately selected from various types of release layers, for example, a type of release layer which is transferred onto a receptor at the time of thermal transfer, another type of release layer which remains on the support side at the time of thermal transfer, and still another type of release layer which undergoes cohesive failure at the time of thermal transfer. However, the type of release layer which remains on the support side at the time of thermal transfer is preferred for the following reason: When a protective layer transfer medium using this type of release layer is used to transfer the protective layer, the interface between the release layer and protective layer in the transfer medium forms the top surface of the protective layer after thermally transferred. This provides stable transfer of the protective layer and good surface gloss of the protective layer transferred.

The coating amount of the release layer is preferably about 0.5 to 5.0 g/m$^2$ on a dry basis. When a protective layer having a mat appearance is desired after transfer, means such as incorporation of various particles into the release layer, and subjecting the surface of the release layer on the side of the protective layer to a matting treatment can be adopted, thereby imparting a mat appearance to the surface of the protective layer transferred. In the case that the protective layer is easily peeled from the support, it is possible to peel the protective layer directly from the support by thermal transfer without providing the release layer.

The protective layer transfer medium of the present invention may have a structure wherein only a protective layer is provided on a support, or another structure wherein a protective layer is provided on a support together with a thermal transfer ink layer or different color thermal transfer ink layers. The thermal transfer ink layer includes a melt-transfer type ink layer and a sublimation-transfer type ink layer.

The protective layer transfer medium of the present invention can be used for producing cards such as an identification card (I.D. card), a certificate card and a license card. These cards contain image information such as photograph and letter information. The printing method can be selected depending upon the type of information. For example, it is possible to form letter information by a melt-transfer type printing method and to form image information such as photograph by a sublimation-transfer type printing method. In such cards, it is possible to provide one or more of an embossing pattern, a signature, an IC memory, a magnetic layer, a hologram and other printing patterns. It is possible to provide an embossing pattern, a signature, a magnetic layer or the like on the card on which a protective layer has been transferred.

A color image and/or letter image are formed on a receptor or a cord substrate on a thermal printer using a thermal transfer ink sheet and then a protective layer is transferred onto the images by using the protective layer transfer medium of the present invention. The formation of the images and the transfer of the protective layer onto the images can be conducted by the transfer medium of the present invention which has a protective layer and thermal transfer ink layer(s) on the same support. In such a transfer step, respective thermal printers wherein transfer conditions are set for sublimation-transfer, melt-transfer and protective layer transfer may be used. A common thermal printer is used with appropriately controlling the printing energy depending upon the sublimation-transfer, melt-transfer or protective layer transfer. The heating means used for transfer of the protective layer from the transfer medium of the present invention is not limited to the thermal printer. Other heating means such as hot plate, hot stamper, hot roll, line heater, and iron can be used. The protective layer may be transferred on either the entire surface or a part of the image formed on a receptor.

By using the protective layer transfer medium of the present invention, it is possible to transfer a protective layer onto a receptor with satisfactory selective transferability regardless of the type of the material of the receptor and the solvent resistance, water resistance and scratch resistance of the protective layer transferred are improved by irradiation with an ionizing radiation.

The present invention will be more specifically described by way of Examples and Comparative Examples. It is to be understood that the present invention is not limited to these Examples, and various changes and modifications may be made in the invention without departing from the spirit and scope thereof. In the following, the term "part" and "%" are represented in terms of weight basis unless otherwise noted.

EXAMPLE 1

Protective layer coating liquid 1 was applied by means of a bar coater at a dry coating thickness of 5 μm onto a front side of a PET film having a thickness of 25 μm with a heat resistant lubricating layer on the rear side thereof. Then thermal adhesive layer coating liquid 1 was applied on the protective layer by means of a bar coater at a dry coating thickness of 0.5 μm, yielding protective layer transfer medium 1.

| Protective layer coating liquid 1 | |
|---|---|
| UV curable acryl-silica hybrid resin (solid content: 30% (with the remainder being solvent), content of silica component: 23% on the basis of the solid content, Tg: 45° C., Mw: 20,000) | 70 parts |
| Photoinitiator (DAROCUR 1173, made by Ciba Speciality Chemicals K.K.) | 1.0 part |
| Sensitizer (UV634A, made by Seiko Advance Ltd.) | 0.6 part |
| Methyl ethyl ketone | 30 parts |
| Thermal adhesive layer coating liquid 1 | |
| Polyester resin (Vylon UR-3200, solid content: 30%, made by Toyobo Co., Ltd.) | 50 parts |
| Toluene | 50 parts |

EXAMPLE 2

Protective layer coating liquid 2 was applied by means of a bar coater at a dry coating thickness of 5 μm onto the front side of a PET film having a thickness of 25 μm with a heat resistant lubricating layer on the rear side thereof. Then thermal adhesive layer coating liquid 1 was applied on the protective layer by means of a bar coater at a dry coating thickness of 0.5 μm in the same manner as in Example 1, yielding protective layer transfer medium 2.

| Protective layer coating liquid 2 | |
|---|---|
| UV curable acryl-silica hybrid resin (solid content: 30% (with the remainder being solvent), content of silica component: 20% on the basis of the solid content, Tg: 55° C., Mw: 25,000) | 70 parts |
| Photoinitiator (DAROCUR 1173, made by Ciba Speciality Chemicals K.K.) | 1.0 part |
| Sensitizer (Kayacure EPA, made by Nippon Kayaku Co., Ltd.) | 1.0 part |
| Methyl ethyl ketone | 30 parts |

COMPARATIVE EXAMPLE 1

Protective layer coating liquid 3 was applied by means of a bar coater at a dry coating thickness of 5 μm onto the front side of a PET film having a thickness of 25 μm with a heat resistant lubricating layer on the rear side thereof. Then the same thermal adhesive layer coating liquid 1 as used in Example 1 was applied on the protective layer by means of a bar coater at a dry coating thickness of 0.5 μm, yielding protective layer transfer medium 3.

| Protective layer coating liquid 3 | |
|---|---|
| Methacrylic acid methyl ester resin (Dianal BR80, made by Mitsubishi Rayon Co., Ltd.) | 20 parts |
| Methyl ethyl ketone | 80 parts |

COMPARATIVE EXAMPLE 2

A paraffin wax having a melting point of 70° C. was applied by means of a hot-melt coater at a coating amount of 0.5 g/m$^2$ onto the front side of a PET film having a thickness of 25 μm with a heat resistant lubricating layer on the rear side thereof, yielding a release layer. Protective layer coating liquid 4 was applied on the release layer by means of a bar coater at a dry coating thickness of 5 μm. Then the same thermal adhesive layer coating liquid 1 as used in Example 1 was applied on the protective layer by means of a bar coater at a dry coating thickness of 0.5 μm, yielding protective layer transfer medium 4. The thus obtained protective layer transfer medium was allowed to stand at 50° C. for 4 days to cure the protective layer.

| Protective layer coating liquid 4 | |
|---|---|
| Polyester resin (Vylon 200, made by Toyobo Co., Ltd.) | 15 parts |
| Isocyanate (Takenate D-204, solid content: 50%, by Mitsui Takeda Chemicals, Inc.) | 10 parts |
| Methyl ethyl ketone | 75 parts |

Each of protective layer transfer media 1, 2, 3 and 4 obtained above was used to conduct solid-printing on an ink jet ink image (obtained by means of an ink jet printer, EPSON PM 730 on a copy sheet for photograph dedicated for the printer) by means of a testing machine for thermal transfer printing (made by Fujicopian Co., Ltd.), thereby effecting an overprinting treatment on the ink jet ink image. The protective layer transferred on the ink jet ink image using protective layer transfer medium 1 or 2 was irradiated with UV rays of integrated light amount of 200 mJ/cm$^2$ by means of a conveyer type UV irradiation apparatus (CS 30 made by Japan Storage Battery Co., Ltd.) to cure the protective layer.

COMPARATIVE EXAMPLE 3

The ink jet ink image mentioned above was used as it was in the evaluation test without providing the overprinting treatment.

EXAMPLE 3

The same protective layer coating liquid 2 as used in Example 2 was applied by means of a bar coater at a dry coating thickness of 5 μm onto one side of a PET film having a thickness of 25 μm. Then thermal adhesive layer coating liquid 1 was applied on the protective layer by means of a bar coater at a dry coating thickness of 1 μm in the same manner as in Example 1, yielding protective layer transfer medium 5.

Protective layer transfer medium 5 was hot-laminated on an acrylic resin plate of 10 cm in length×10 cm in width×2 mm in thickness by means of a hot laminator (made by Kabushiki Kaisha Taisei) at 150° C. and allowed to stand until the temperature decreased to room temperature, and the support was peeled off so that the protective layer was transferred on the acrylic resin plate. The protective layer transferred on the acrylic resin plate was irradiated with UV rays of integrated light amount of 200 mJ/cm$^2$ by means of a conveyer type UV irradiation apparatus (CS 30 made by Japan Storage Battery Co., Ltd.) to cure the protective layer.

COMPARATIVE EXAMPLE 4

The acrylic resin plate mentioned above was used as it was in the evaluation test without providing the overprinting treatment.

Evaluation

Selective Transferability

○: Good selective transferability

Δ: Planar peeling tends to occur.

x: Planar peeling occurs markedly.

Water Resistance and Solvent Resistance

A drop of water, ethanol, methyl ethyl ketone (MEK) or toluene was dropped on the test piece (protective layer) and wiped off after 30 minutes to observe the state of the test piece.

○: No change.

Δ: The test piece (ink jet ink image or acrylic resin plate) is somewhat damaged.

x: The test piece (ink jet ink image or acrylic resin plate) is markedly damaged.

Scratch Resistance

The test piece (protective layer) was rubbed ten times with steel wool (Bon Star #0000) at a load of 250 g/cm$^2$.

○: No change

Δ: Some scratches are made on the test piece (protective layer).

x: Scratches are markedly made on the test piece (protective layer).

The results of the evaluation above are shown in Table 1.

TABLE 1

| Evaluation item | Ex. 1 | Ex. 2 | Com. Ex. 1 | Com. Ex. 2 | Com. Ex. 3 | Ex. 3 | Com. Ex. 4 |
|---|---|---|---|---|---|---|---|
| Selective transferability | ○ | ○ | Δ | x | — | ○ | — |
| Water resistance | ○ | ○ | ○ | ○ | Δ | ○ | ○ |
| Ethanol resistance | ○ | ○ | ○ | ○ | Δ | ○ | ○ |
| MEK resistance | ○ | ○ | x | ○ | Δ | ○ | x |
| Toluene resistance | ○ | ○ | Δ | ○ | ○ | ○ | Δ |
| Scratch resistance | ○ | ○ | x | x | x | ○ | x |

What is claimed is:

1. A transfer medium for transferring a protective layer, comprising at least one protective layer provided on a support, the protective layer comprising as a main component by weight an acryl-silica hybrid resin curable by irradiation with an ionizing radiation.

2. The transfer medium of claim 1, wherein the acryl-silica hybrid resin contains 15 to 60% by weight of a silica component and does not show tackiness at an ordinary temperature before curing.

3. The transfer medium of claim 1, wherein the acryl-silica hybrid resin has a glass transition temperature of not less than 30° C. before curing.

4. The transfer medium of claim 1, which further comprises a thermal adhesive layer as an outermost layer.

* * * * *